US008455406B2

(12) United States Patent
Shah

(10) Patent No.: US 8,455,406 B2
(45) Date of Patent: Jun. 4, 2013

(54) COMPRESSOR OILS HAVING IMPROVED OXIDATION RESISTANCE

(75) Inventor: Ravindra Shah, Concord, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 230 days.

(21) Appl. No.: 12/914,896

(22) Filed: Oct. 28, 2010

(65) Prior Publication Data

US 2012/0108479 A1 May 3, 2012

(51) Int. Cl.
*C10M 169/04* (2006.01)

(52) U.S. Cl.
USPC ..... 508/110

(58) Field of Classification Search
USPC ..... 508/110
See application file for complete search history.

(56) References Cited

U.S. PATENT DOCUMENTS

| | | | | |
|---|---|---|---|---|
| 2002/0086803 | A1 | 7/2002 | Berlowitz et al. | |
| 2008/0096779 | A1 | 4/2008 | Okazaki et al. | |
| 2009/0042755 | A1* | 2/2009 | Okazaki | 508/428 |
| 2009/0181871 | A1* | 7/2009 | Shah et al. | 508/459 |

FOREIGN PATENT DOCUMENTS

| | | | |
|---|---|---|---|
| EP | 1006173 | A1 | 7/2000 |
| JP | 09087648 | A | 3/1997 |

OTHER PUBLICATIONS

PCT International Search Report, Application No. PCT/US2011/056290, dated May 31, 2012, mailed Jul. 26, 2012.

* cited by examiner

*Primary Examiner* — Taiwo Oladapo
(74) *Attorney, Agent, or Firm* — Penny L. Prater

(57) ABSTRACT

A compressor lubricant composition providing energy savings and exhibiting excellent oxidation stability is provided, as well as a process for preparation of the lubricant composition. The composition comprises: (i) from 68 to 99.999 wt % of an isomerized base oil or blend of isomerized base oils; (ii) 0.001 through 20 wt % of a blend of ashless additives, the ashless additives having a viscosity range at 40° C. of from 50 $mm^2/s$ to 60 $mm^2/s$, a density at 20° C. of from 0.95 through 1.05 $g/cm^3$, a flash point of greater than 100° C. (COC), solubility in mineral oil of greater than 5 wt %, sulfur content of from 4.8 wt % through 6.0 wt %, and phosphorus content of from 2.9 through 3.6 wt %; (iii) less than 1.0 wt % of a dithiocarbamate, wherein the Conradson carbon residue is less than or equal to 3.00. The dithiocarbamate is added to the base oil blend as a top treatment.

21 Claims, No Drawings

COMPRESSOR OILS HAVING IMPROVED OXIDATION RESISTANCE

FIELD OF THE INVENTION

Improvement of oxidative stability of compressor oil, particularly those made with Group II or Group III base oil.

BACKGROUND OF THE INVENTION

Approximately 70% of all manufacturers employ a compressed air system. These systems power and regulate a variety of equipment, including machine tools, machine handling and separation equipment, spray painting equipment, HVAC systems, etc. They are also used to dry or clean various items in industrial facilities.

Compressed air is one of the most expensive uses of energy in a manufacturing plant. About eight horsepower of electricity is used to generate one horsepower of compressed air. Air compressor energy use may represent 5 to 15% of a typical facility's energy use, depending on process needs. Energy audits by the U.S. Department of Energy ("DOE") suggest that approximately 8.6% of overall industrial energy consumption can be attributed to air compression. The DOE suggested that over 50% of compressed air systems at small to medium sized industrial facilities have energy efficiency opportunities with low implementation costs (DOE/IAC Industrial Assessment Database, July 1997). Another source has suggested that energy efficient improvements can reduce compressed air system energy use by 20 to 50% (Oregon State University, AIRMaster Compressed Air System Audit and Analysis Software, "How to Take a Self-Guided Tour of Your Compressed Air System," 1996 revised in 1997, p. 2).

Suggestions for air compressor improvements include matching compressor with load requirement, using cooler intake air, reducing compressor air pressure, eliminating air leaks, etc. Another energy suggestion relates to compressor lubricants, i.e., "synthetic compressor oils save at least 2% energy in compressors compared to the traditional mineral oils" (http://www.oks-india.com/user/questionanswer.asp) While synthetic lubricants are an improvement over mineral oils in terms of energy saving, they are often not capable of delivering all of the desired performance and physical properties. There is a still a need for improved compressor lubricants using base oils in the Group II and Group III categories, particularly compressor lubricants resulting in reduced energy consumption while offering desired performance and physical properties such as long life, oxidation stability, low volatility, and anti-wear properties. There is also a need for an improved compressor lubricant using clean alternative hydrocarbon products such as Fischer Tropsch products used in the manufacture of Group II and III base oils.

It is assumed in the lubricant industry that Group II and Group III base oils, which are hydroprocessed, have a better oxidative stability than Group I base oils. It is therefore to be expected that a finished lubricant formulated in Group II or Group III base oils will have better oxidative stability than a finished lubricant formatted in Group I base oils. (The characteristics of API Base Stock categories, including characteristics of Groups I-V base oils, are set forth in Table 1, below.) This has not been found to be the case when oxidative performance of the finished lubricant formulated in Group II or Group III base oils is compared against a finished lubricant formulated in Group I base oils by the "Pneurop" test, which is set forth in the German DIN 51506 instructions. In the Pneurop test a petroleum based lubricating oil is characterized by the increase in the Conradson carbon residue compared with that of a non-aged oil. Aging of the oil is accomplished by passing air through it in the presence of ferrous oxide for set periods of time under conditions specified in the test instructions. DIN 51506 refers to DIN 51352 Parts 1 and 2 for more specific details.

Certain markets require the use of Group II base oils in compressor lubricants, so it was necessary to overcome the oxidative stability problem. Previous efforts included increasing the antioxidant treat rate of the finished oil, as well as supplementing the finished lubricant with phenolic and/or aminic antioxidants, with only limited success. The finished lubricant was also treated with containing sulfur. It was discovered that this type of antioxidant improved the performance significantly at minimal cost.

TABLE 1

API Base stock categories

| Group | Sulfur (percent by weights) | | Saturates (percent) | Viscosity Index |
|---|---|---|---|---|
| I | >0.03 | and/or | <90 | ≧80-<120 |
| II | ≦0.03 | And | ≦90 | ≧80-<120 |
| III | ≧0.03 | And | ≧90 | ≧120 |
| IV | All Polyalphaolefins (PAOs) | | | |
| V | All base stocks not included in Groups I-IV (Naphthenics and synthetics other than PAOs) | | | |

SUMMARY OF THE INVENTION

In one embodiment, there is provided a compressor lubricant composition possessing excellent oxidative stability comprising (i) 68 to 99.999 wt % of an isomerized base oil or blend of isomerized base oils; and (ii) 0.001 through 20 wt % of a blend of ashless additives, a viscosity at 40° C. of from 50 $mm^2/s$ to 60 $mm^2/s$, a density at 20° C. of from 0.95 through 1.05 $g/cm^3$, flash point of greater than 100° C. (COC), solubility in mineral oil of greater than 5 wt %, sulfur content of from 4.8 through 6.0 wt %, and phosphorus content of from 2.9 through 3.6 wt % (iii) less than 1.0 wt % of a dithiocarbamate.

In another embodiment, a process for the preparation of a compressor lubricant composition which possesses excellent oxidative stability comprises top treating an isomerized base oil blend with less than 1.0 wt % of dithocarbamate, said composition comprising: (i) 80 to 99.999 weight percent of an isomerized base oil; (ii) 0.001 through 20 weight percent of a blend of ashless additives, said blend having a viscosity at 40° C. from 50 to 60 $mm^2/s$, a density at 20° C. of from 0.95 through 1.05 $g/cm^3$, a flash point of greater than 100° C. (COC), solubility in mineral oil of greater than 5%, a sulfur content of from 4.8 through 6.0%, and a phosphorus content of from 2.9 through 3.6%; and (iii) less than 1.0 wt % of a dithiocarbamate.

DETAILED DESCRIPTION OF THE INVENTION

The following terms will be used throughout the specification and will have the following meanings unless otherwise indicated.

As used herein, "isomerized base oil" refers to a base oil made by isomerization of a waxy feed. An "isomerized base oil blend" refers to base oil which has been combined with additives.

As used herein, a "waxy feed" comprises at least 40 wt % n-paraffins. In one embodiment, the waxy feed comprises greater than 50 wt % n-paraffins. In another embodiment, greater than 75 wt % n-paraffins. In one embodiment, the waxy feed also has very low levels of nitrogen and sulphur, e.g., less than 25 ppm total combined nitrogen and sulfur, or in other embodiments less than 20 ppm. Examples of waxy feeds include slack waxes, deoiled slack waxes, refined foots oils, waxy lubricant raffinates, n-paraffin waxes, normal alpha olefin (NAO) waxes, waxes produced in chemical plant processes, deoiled petroleum derived waxes, microcrystalline waxes, Fischer-Tropsch waxes, and mixtures thereof. In one embodiment, the waxy feeds have a pour point of greater than 50° C. In another embodiment, greater than 60° C. The waxy feeds suitable for use in this invention may be processed to produce both Group II and Group III base oils.

In one embodiment, the isomerized base oil is made from a process in which the highly paraffinic wax is hydroisomerized under conditions for the base oil to have a kinematic viscosity at 100° C. of 3.6 to 4.2 $mm^2/s$, a viscosity index of greater than 130, a wt % Noack volatility less than 12, a pour point of less than −9° C.

In one embodiment, the base oil or blend thereof comprises at least an isomerized base oil which the product itself, its fraction, or feed originates from or is produced at some stage by isomerization of a waxy feed from a Fischer-Tropsch process ("Fischer-Tropsch derived base oils"). In another embodiment, the base oil comprises at least an isomerized base oil made from a substantially paraffinic wax feed ("waxy feed"). In a third embodiment, the isomerized base oil comprises mixtures of products made from a substantially paraffinic wax feed as well as products made from a waxy feed from a Fischer-Tropsch process.

"Fischer-Tropsch derived" means that the product, fraction, or feed originates from or is produced at some stage by a Fischer-Tropsch process. As used herein, "Fischer-Tropsch base oil" may be used interchangeably with "FT base oil," "FTBO," "GTL base oil" (GTL: gas-to-liquid), or "Fischer-Tropsch derived base oil."

Fischer-Tropsch derived base oils are disclosed in a number of patent publications, including for example U.S. Pat. Nos. 6,080,301, 6,090,989, and 6,165,949, and U.S. Patent Publication No. US2004/0079678A1, US20050133409, US20060289337. The Fischer-Tropsch process is a catalyzed chemical reaction in which carbon monoxide and hydrogen are converted into liquid hydrocarbons of various forms including a light reaction product and a waxy reaction product, with both being substantially paraffinic.

In a number of patent publications and applications, i.e., US 2006/0289337, US2006/0201851, US2006/0016721, US2006/0016724, US2006/0076267, US2006/020185, US2006/013210, US2005/0241990, US2005/0077208, US2005/0139513, US2005/0139514, US2005/0133409, US2005/0133407, US2005/0261147, US2005/0261146, US2005/0261145, US2004/0159582, U.S. Pat. No. 7,018,525, U.S. Pat. No. 7,083,713, U.S. application Ser. Nos. 11/400,570, 11/535,165 and 11/613,936, which are incorporated herein by reference, a Fischer Tropsch base oil is produced from a process in which the feed is a waxy feed recovered from a Fischer-Tropsch synthesis. The process comprises a complete or partial hydroisomerization dewaxing step, using a dual-functional catalyst or a catalyst that can isomerize paraffins selectively. Hydroisomerization dewaxing is achieved by contacting the waxy feed with a hydroisomerization catalyst in an isomerization zone under hydroisomerizing conditions. The Fischer-Tropsch synthesis products can be obtained by well-known processes such as, for example, the commercial SASOL® Slurry Phase Fischer-Tropsch technology, the commercial SHELL® Middle Distillate Synthesis (SMDS) Process, or by the non-commercial EXXON®Advanced Gas Conversion (AGC-21) process. Details of these processes and others are described in, for example, EP-A-776959, EP-A-668342; U.S. Pat. Nos. 4,943,672, 5,059,299, 5,733,839, and RE39073; and US Published Application No. 2005/0227866, WO-A-9934917, WO-A-9920720 and WO-A-05107935. The Fischer-Tropsch synthesis product usually comprises hydrocarbons having 1 to 100, or even more than 100 carbon atoms, and typically includes paraffins, olefins and oxygenated products. Fischer Tropsch is a viable process to generate clean alternative hydrocarbon products in the categories of both Groups II and III.

"Kinematic viscosity" is a measurement in $mm^2/s$ of the resistance to flow of a fluid under gravity, determined by ASTM D445-06.

"Viscosity index" (VI) is an empirical, unit-less number indicating the effect of temperature change on the kinematic viscosity of the oil. The higher the VI of an oil, the lower its tendency to change viscosity with temperature. Viscosity index is measured according to ASTM D 2270-04.

The compressor oil composition in one embodiment further comprises additives including but not limited to extreme pressure additives, anti-wear additives, metal passivators/deactivators, metallic detergents, corrosion inhibitors, foam inhibitors and/or demulsifiers, anti-oxidants, friction modifiers, pour point depressants, viscosity index modifiers, in an amount of 0.01 to 20 wt. %.

Depending on the isomerized base oils for use as the base oil, the compressor lubricant composition is tailored to meet any of the ISO viscosity grades, including ISO 32, 46, 68, ISO 100, or ISO 150. Table II provides the kinematic viscosity limits for these grades at 40° C.

TABLE II viscosity system for industrial fluid lubricants

| Viscosity System Grade | Mid-Point Viscosity, | Kinematic Viscosity Limits, ($mm^2/s$) at 40.0° C. | |
|---|---|---|---|
| ID | cSt ($mm^2/s$) at 40.0° C. | min. | max |
| ISO VG 32 | 32 | 28.8 | 35.2 |
| ISO VG 46 | 46 | 41.4 | 50.6 |
| ISO VG 68 | 68 | 61.2 | 74.8 |
| ISO VG 100 | 100 | 90.0 | 110 |
| ISO VG 150 | 150 | 135 | 165 |

Discussion of Data

This invention employs proprietary blends of ashless additives used to formulate ashless antiwear hydraulic oils and compressor lubricants. Such additive blends include demulsifier and antifoam additives. Their typical characteristics are described in Table III. Such additives are required in the preparation of the compressor lubricants of this invention. Their use often results in oxidation stability problems for compressor lubricants formulated with Group II oils, however.

TABLE III

| Typical chemical and physical properties of an ashless additive industry package used in this invention | |
|---|---|
| Appearance | Clear, yellow to brown liquid |
| Viscosity at 40° C. | 50-60 $mm^2/s$ |
| Density at 20° C. | 0.95-1.05 $g/cm^3$ |
| Flash point | >100° C. (COC) |
| Solubility in mineral oil | >5% |
| Sulfur content | 4.8-6.0% |
| Phosphorus content | 2.9-3.6% |

In the "Pneurop" test, which is set forth in DIN 51506, a petroleum based lubricating oil is characterized by the increase in the Conradson carbon residue compared with that of a non-aged oil. Aging of the oil is accomplished by passing air through it in the presence of Ferrous oxide for set periods of time under conditions specified in the test instructions. DIN 51506 refers to DIN 51352 Parts 1 and 2 for more specific details. Part 1 refers to testing of lubricants, determination of aging characteristics of lubricating oils, and details on Conradson carbon residue after aging by passing through the lubricating oil. Part 2 provides details on Conradson carbon residue after aging by passing through the lubricating oil in the presence of $Fe_2O_3$.

Under DIN 51506 standard the acceptable limits for oxidation performance are: Less than or equal to 2.5% wt. Conradson carbon residue for ISO grade 46 and lower, less than or equal to 3 wt. % for ISO grades 68 to 150. The test method is suitable when total evaporation loss is 20 wt % or less under this method. As Table IV indicates, Typically Group I oils work well with ashless additives such as those in Table III. Table IV depicts different Group I blends at different ISO grades. Each grade fell within acceptable parameters for % Evaporation loss and wt % Conradson carbon residue established under DIN 51506.

TABLE IV

| Group I Blends at Different ISO Grades | | | | |
|---|---|---|---|---|
| Base Oil/Grade | ISO 32 | ISO 68 | ISO 100 | ISO 50 |
| Components | | | | |
| 150 Neutral (Group I) | 88.99 | 21.05 | | |
| 500 Neutral (Group I) | 10.38 | 78.33 | 91.34 | 67.28 |
| Brightstock 160 (Group I) | | | 8.04 | 32.1 |
| Ashless additive | 0.55 | 0.55 | 0.55 | 0.55 |
| Pour point depressant | 0.07 | 0.07 | 0.07 | 0.07 |
| Foam inhibitor | 0.01 | 0.01 | 0.01 | 0.01 |
| Viscosity, Kinematic, 40° C. | 31.97 | 68.34 | 100.9 | 150.6 |
| Pneurop Oxidation Test | | | | |
| Evaporation Loss, wt % | 17.31 | 6.00 | 5.06 | 2.81 |
| Conradson Carbon, wt % | 2.07 | 0.44 | 2.57 | 0.95 |

Table V depicts two Group II blends of ISO grade 46 that did not work well with an ashless additive blend. In both cases the Conradson Carbon residue was over 3 wt %, when it should be no greater than 2.5 wt % under the Pneurop test. In these examples the Evaporation Loss and Conradson Carbon were measured in duplicate, and both results are reported.

TABLE V

| Group II Blends | | |
|---|---|---|
| Base oil/grade | ISO 46 | ISO 46 |
| 220 Neutral (Group II) | | 99.37 |
| 100 Neutral (Group II) | 46.37 | |
| 600 Neutral (Group II) | 53.00 | |
| Ashless additive package | 0.55 | 0.55 |
| Pour point depressant | 0.07 | 0.07 |
| Foam inhibitor | 0.01 | 0.01 |
| Viscosity at 40° C. | 46.06 | 42.34 |
| Pneurop Oxidation Test | — | — |
| Evaporation Loss, wt % | 19.99/20.92 | 17.73/16.25 |
| Conradson Carbon, wt % | 3.13/3.47 | 3.77/3.16 |

We have discovered that top treatment of the base oil blend with a dithiocarbamate additive, can be effective in reducing the Conradson Carbon content in certain Group II blends to acceptable levels. One such additive is composed of methylene-bis-dibutyldithiocarbamate, although other dithiocarbamates, particularly dialkyldithiocarbamates, can be similarly effective. "Top Treating" as used here, describes a means of adjusting an existing formulation to correct a specific problem.

TABLE VI

| Typical Characteristics of a dialkyldithiocarbamate | |
|---|---|
| Appearance | Amber |
| Viscosity at 40° C. | 45-55 $mm^2/s$ |
| Density at 25° C. | 0.8-1.2 $g/cm^3$ |
| Flash point | 120-135° C. (COC) |
| Composition | Sulfur-phosphorus hydrocarbon |
| Sulfur content | 10-20 wt % |
| Phosphorus content | 0.50-0.75 wt % |

Table VII illustrates the amount of dithiocarbamate additive necessary to reduce the Conradson Carbon content to acceptable levels for different ISO grades of interest, provided the weight percent of evaporation is maintained at less than 20 wt %.

TABLE VII

| ISO Grade | Top Treat % |
|---|---|
| 32 | 0.60 |
| 46 | 0.45 |
| 68 | 0.30 |
| 100 | 0.15 |
| 150 | 0 |

The results of Table VII were obtained from the data in Table VIII, below. Table VIII shows that different amounts of dithiocarbamate, are required to attain an acceptable level of Conradson Carbon for different ISO grades, with evaporation below 20 wt %. The gray blocks indicate trials in which results acceptable under the Pneurop test were attained. Other antioxidant additives containing sulfur, such as high sulfur gear oil or diphenyl amine were tried alternately with unacceptable results.

TABLE VIII

| Pneurop Test Results | | | | | | | | | | | |
|---|---|---|---|---|---|---|---|---|---|---|---|
| Base Oil/Grade | ISO32 | ISO32 | ISO32 | ISO32 | ISO32 | ISO32 | ISO32 | ISO68 | ISO68 | ISO100 | ISO150 |
| Components | | | | | | | | | | | |
| 150 Neutral (Group I or II) | 92.88 | 92.75 | 92.84 | 92.86 | 92.08 | 91.85 | 91.49 | 30.52 | 30.71 | 1.71 | |
| 600 Neutral (Group II) | 6.04 | 6.17 | 5.94 | 5.92 | 7.08 | 7.2 | 7.39 | 68.86 | 68.37 | 97.52 | 70.25 |
| Brightstock 160 (Group I) | | | | | | | | | | | 29.13 |
| -ashless additives | 0.55 | 0.55 | 0.55 | 0.55 | 0.55 | 0.55 | 0.55 | 0.55 | 0.55 | 0.55 | 0.55 |
| Diphenyl amine | 0.45 | | | | | | | | | | |
| Dithiocarbamate antioxidant I | | | | 0.6 | | | | | | | |
| High S gearoil additive | | | | | 0.22 | 0.33 | 0.5 | | | | |
| Dithiocarbamate antioxidant | | 0.45 | 0.6 | | | | | | 0.3 | 0.15 | |
| Pour point depressant | 0.07 | 0.07 | 0.07 | 0.07 | 0.07 | 0.07 | 0.07 | 0.07 | 0.07 | 0.07 | 0.07 |
| Foam inhibitor | 0.01 | 0.01 | 0.01 | 0.01 | 0.01 | 0.01 | 0.01 | 0.01 | 0.01 | 0.01 | 0.01 |
| Total | 100 | 100 | 100.01 | 100.01 | 100.01 | 100.01 | 100.01 | 100.01 | 100.01 | 100.01 | 100.01 |
| Viscosity, Kinematic, 40 C. | 32.19 | 32.36 | 32.13 | 32.07 | 32.21 | 32.19 | 32.14 | 67.75 | 67.38 | 96.64 | 153.1 |
| Pneurop Oxidation Text | | | | | | | | | | | |
| % Evaporation Loss | 28.92 | 22.39 | 15..28 | 19.53 | 22.16 | 23.55 | 20.51 | 16.37 | 9.4 | 5.75 | 2.03 |
| Conradson Carbon, wt % | 4.91 | 1.87 | 2.25 | 3.4 | 3.92 | 3.96 | 3.1 | 4.62 | 2.96 | 2.02 | 0.46 |

What is claimed is:

1. A compressor lubricant composition possessing excellent oxidative stability, said composition comprising:

(i) from 68 to 99.999 wt % of an isomerized base oil or blend of isomerized base oils;

(ii) 0.001 through 20 wt % of a blend of an ashless additives having a viscosity at 40° C. in the range of from of from 50 $mm^2/s$ to 60 $mm^2/s$, a density at 20° C. of from 0.95 through 1.05 $g/cm^3$, flash point of greater than 100° C.(COC), solubility in mineral oil of greater than 5 wt. %, sulfur content of from 4.8 through 6.0 wt %, and phosphorus content of from 2.9 through 3.6 wt. %;

(iii) less than 1.0 wt % of a dithiocarbamate.

2. The lubricant composition of claim 1, wherein the isomerized base oil is selected from the group consisting of ISO grades 32, 46, 68, 100 and 150.

3. The lubricant composition of claim 1, wherein the Conradson carbon residue is less than or equal to 3.00.

4. The lubricant composition of claim 3, wherein the Conradson carbon residue is less than or equal to 2.50.

5. The lubricant of claim 3, wherein the total evaporation loss is no more than 20 wt. %.

6. The lubricant composition of claim 5, wherein the total evaporation loss is no more than 15 wt. %.

7. The lubricant composition of claim 1, wherein the isomerized base oil comprises Group II or Group III base oil.

8. The lubricant composition of claim 7, wherein the isomerized base oil is Fischer-Tropsch derived.

9. The lubricant composition of claim 1, wherein the dithiocarbamate is a dialkyldithiocarbamate.

10. The lubricant composition of claim 9, wherein the dialkyldithiocarbamate is a dibutyldithiocarbamate.

11. The lubricant composition of claim 1, wherein said blend of ashless additives is a liquid.

12. The lubricant composition of claim 11, wherein the liquid blend of ashless additives is colorless, yellow or brown.

13. The lubricant composition of claim 1, which further comprises a pour point depressant.

14. The lubricant composition of claim 1, which further comprises a foam inhibitor.

15. he lubricant composition of claim 1, which further comprises a brightstock.

16. The lubricant composition of claim 1, in which the ashless additive is present in an amount no greater than 1 wt %.

17. The lubricant compositions of claim 1, in which no additional antioxidants are present.

18. The lubricant composition of claim 1, wherein the isomerized base oil is made by isomerization of a waxy feed.

19. A process for the preparation of a compressor lubricant composition which possesses excellent oxidative stability, said method comprising the step of top treating with less than 1.0 wt % of dithocarbamate an isomerized base oil blend, said blend comprising a blend of ashless additives, to produce a composition comprising:

(i) 80 to 99.999 weight percent of an isomerized base oil;

(ii) 0.001 through 20 weight percent of a blend of ashless additives, said blend having a viscosity at 40° C. from 50 $mm^2/s$ to 60 $mm^2/s$, a density at 20° C. of from 0.95 through 1.05 g/cm3, a flash point of greater than 100°

C.(COC), solubility in mineral oil of greater than 5%, a sulfur content of from 4.8 through 6.0%, and a phosphorus content of from 2.9 through 3.6%; and (iii) less than 1.0 wt % of a dithiocarbamate.

20. The process of claim 19, wherein the amount of the dithiocarbamate added to the isomerized base oil blend by top treating is dependent upon the ISO grade of the oil.

21. A compressor lubricant composition possessing excellent oxidative stability, said composition comprising:

(i) from 68 to 99.999 wt % of an isomerized base oil or blend of isomerized base oils wherein the isomerized base oil comprises a Group II base oil or a Group III base oil; (ii) 0.001 through 20 wt % of a blend of an ashless additives having a viscosity at 40° C. in the range of from of from 50 $mm^2/s$ to 60 $mm^2/s$, a density at 20° C. of from 0.95 through 1.05 $g/cm^3$, flash point of greater than 100° C.(COC), solubility in mineral oil of greater than 5 wt. %, sulfur content of from 4.8 through 6.0 wt %, and phosphorus content of from 2.9 through 3.6 wt. %;

(iii) less than 1.0 wt % of a dithiocarbamate;

(iv) Wherein in the Conradson carbon residue is less than or equal to 2.50 wt. % and the total evaporation loss is no more than 20 wt. %.

* * * * *